US012383054B1

(12) United States Patent
Nelson

(10) Patent No.: US 12,383,054 B1
(45) Date of Patent: Aug. 12, 2025

(54) RECONFIGURABLE TABLES

(71) Applicant: FERNWEH WOODWORKING, LLC, Bend, OR (US)

(72) Inventor: Justin Nelson, Bend, OR (US)

(73) Assignee: Fernweh Woodworking, LLC, Bend, OR (US)

( * ) Notice: Subject to any disclaimer, the term of this patent is extended or adjusted under 35 U.S.C. 154(b) by 0 days.

(21) Appl. No.: 18/806,928

(22) Filed: Aug. 16, 2024

(51) Int. Cl.
*A47B 13/00* (2006.01)
*A47B 13/02* (2006.01)

(52) U.S. Cl.
CPC .... *A47B 13/021* (2013.01); *A47B 2200/0063* (2013.01)

(58) Field of Classification Search
CPC ..... A47B 13/021; A47B 13/022; A47B 5/06; A47B 2200/0063
USPC ..... 108/12, 153.1, 154, 156, 157.1, 157.16; 248/188.1, 172, 173, 188, 188.8, 165, 178
See application file for complete search history.

(56) References Cited

U.S. PATENT DOCUMENTS 1,350,963 A * 8/1920 Fowler ..... B62B 3/02 248/172
1,953,655 A * 4/1934 Miller ..... A47B 17/036 312/282
2,563,891 A * 8/1951 Wallance ..... A47B 1/08 108/79
4,033,653 A * 7/1977 Doring ..... A47B 37/00 248/172
5,182,996 A * 2/1993 Gutgsell ..... A47B 87/002 108/89
8,359,983 B2 1/2013 Williamson et al.
10,827,761 B1 * 11/2020 Graham ..... A22C 25/06
11,470,958 B2 10/2022 Levy et al.
2009/0183657 A1 * 7/2009 Fischer ..... A47B 13/021 108/156

FOREIGN PATENT DOCUMENTS

DE 2029034 A1 * 12/1971
DE 3816269 A1 * 11/1989
DE 29818708 U1 * 3/2000 ..... A47B 13/021
EP 1279352 A1 * 1/2003 ..... A47B 1/04
ES 2320307 A1 * 5/2009 ..... A47B 13/02
(Continued)

OTHER PUBLICATIONS

KR102106741 English translation (Year: 2020).*
KR473602 English translation (Year: 2014).*

*Primary Examiner* — Janet M Wilkens
(74) *Attorney, Agent, or Firm* — Leber IP Law; Celia H. Leber

(57) ABSTRACT

Reconfigurable tables are disclosed. In some implementations a table includes a generally planar table top having an upper surface and a lower surface, and a plurality of legs, each leg having a vertical leg portion having a proximal end adjacent the lower surface and a distal end configured to contact a floor surface to support the table top at a predetermined distance from the floor surface. At least one of the legs is a pivoting leg, the pivoting leg further including a horizontal elongated support arm that is pivotably mounted to the lower surface at a proximal end and joined to the vertical leg portion at a distal end. In other implementations the orientation of the legs is adjustable by sliding the legs along a channel.

9 Claims, 22 Drawing Sheets

(56) References Cited

FOREIGN PATENT DOCUMENTS

| | | | | | |
|---|---|---|---|---|---|
| JP | 6553208 | B2 | | 7/2019 | |
| KR | 473602 | Y1 | * | 7/2014 | ..... A47B 13/021 |
| KR | 102106741 | B1 | * | 5/2020 | |
| SE | 510131 | C2 | * | 4/1999 | ..... A47B 13/021 |
| WO | WO-2024213530 | A1 | * | 10/2024 | |

* cited by examiner

RECONFIGURABLE TABLES

BACKGROUND

In order to accommodate groups of different sizes, whether in a restaurant, meeting room, private home or other setting, it is common to move tables together to provide a larger table surface. However, this often results in discomfort for users who are seated near table legs, and/or limits the number of users that can be seated around an arrangement of tables having a given table surface.

Even when only a single table is used, the position of the table legs may pose accessibility issues, e.g., to users in wheelchairs or with certain disabilities.

SUMMARY

The present disclosure features reconfigurable tables in which the orientation of a portion of the leg extending perpendicular to the table top can be changed, e.g., so that the position of the leg is out of the way of a person seated at the table.

In some implementations the legs include an arm that allows the leg to pivot about a pivot axis at which the arm is secured to the lower surface of the table top. The ability to pivot the legs into different positions allows a user to swing the legs of a single table out of the way, e.g., to provide more seating or to accommodate users with accessibility needs. The pivoting legs also allow the tables to be easily reconfigured to maximize seating capacity when two or more tables are positioned together.

In one aspect, the disclosure features a table that includes (a) a generally planar table top having an upper surface and a lower surface; and (b) a plurality of legs, each leg having a vertical leg portion having a proximal end adjacent the lower surface and a distal end configured to contact a floor surface to support the table top at a predetermined distance from the floor surface. At least one of the legs is a pivoting leg, the pivoting leg further including a horizontal elongated support arm that is pivotably mounted to the lower surface at a proximal end and joined to the vertical leg portion at a distal end.

Some implementations include one or more of the following features.

The horizontal elongated support arm may be disposed in a plane that is generally parallel to a plane defined by the lower surface. The horizontal elongated support arm may include an upper surface that is configured to contact and support the lower surface.

The table top may be generally square or rectangular and the table comprises at least four corner legs, arranged at corners of the table top. In some cases all four of the corner legs are pivoting legs.

The table may include at least two pivoting legs that pivot about a common pivot axis. For example, proximal ends of the horizontal elongated support arms of the two pivoting legs may include tongues that are positioned one on top of the other, the tongues having coaxial through bores, and the table further comprises a pivoting mechanism positioned in the coaxial through bores and extending into a lower surface of the table top.

The pivoting leg(s) may be pivotable between at least two predetermined positions. Each pivoting leg may further comprise a fastener disposed in the horizontal elongated support arm and configured to secure the pivoting leg in each of the predetermined positions.

Alternatively, the lower surface of the table may include an arcuate groove and the pivoting leg further comprise a protrusion disposed in the horizontal elongated support arm and configured to travel within the groove when the leg is pivoted.

According to another aspect, the disclosure features a table that includes (a) a generally horizontal, generally planar table top having an upper surface and a lower surface, the table top being rectangular or square; (b) at least one elongated channel mounted on the lower surface and having an open slot facing away from the lower surface; and (c) a plurality of legs, each leg having a proximal end adjacent the lower surface and a distal end configured to contact a floor surface to support the table top at a predetermined distance from the floor surface. At least one of the legs has a proximal end that is generally T-shaped in cross-section, the proximal end being slidably mounted in the open slot of the channel.

Some implementations of this aspect of the disclosure may include one or more of the following features.

The table top may be generally square or rectangular and the table comprises at least four legs. The table top may be rectangular and the table may include two of the elongated channels extending longitudinally parallel to long edges of the table top, with at least two of the legs disposed in each of the elongated channels.

In yet another aspect the disclosure features a table that includes (a) a generally horizontal, generally planar table top having an upper surface and a lower surface; and (b) a plurality of legs, each leg having a vertical leg portion extending from the lower surface to a floor surface to support the table top at a predetermined distance from the floor surface. At least one of the legs has a proximal end that is mounted on the lower surface in a manner that allows a user to adjust the orientation of the proximal end of the vertical leg portion relative to the table top when the vertical leg portion is generally perpendicular to the table top.

The disclosure also features methods of providing and utilizing reconfigurable tables.

In one aspect, the disclosure features a method of providing a reconfigurable table, the method comprising: (A) providing a table that includes (a) a generally planar table top having an upper surface and a lower surface; and (b) a plurality of legs, each leg having a vertical leg portion having a proximal end adjacent the lower surface and a distal end configured to contact a floor surface to support the table top at a predetermined distance from the floor surface; wherein at least one of the legs is a pivoting leg, the pivoting leg further including a horizontal elongated support arm that is pivotably mounted to the lower surface at a proximal end and joined to the vertical leg portion at a distal end; and (B) changing the orientation of the vertical leg portion of the at least one pivoting leg, with the vertical leg portion remaining generally perpendicular to the lower surface, by pivoting the horizontal elongated support arm.

The term "table," as used herein, includes any piece of furniture having a planar generally horizontal top surface and three or more legs configured to support the top surface at a predetermined distance from a floor surface. For example, "table," is meant to include dining room tables, conference room tables, coffee tables, work tables and desks in the form of tables, tables used to support patients or for other uses in the medical and veterinary fields, and other pieces of furniture having a table top and legs.

The phrase "floor surface," as used herein includes both indoor floors in residential, commercial, and public buildings, and indoor or outdoor ground surfaces such as in parks, gardens, athletic facilities and the like.

Within this specification embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

DETAILED DESCRIPTION

The tables disclosed herein can be used alone, to provide various seating options or to allow the tables to be used in different spaces (e.g., up against a wall, in a corner, or in the open). A table can also be configured to allow for storage of objects under an area of the table that would ordinarily be obstructed by a table leg.

When two or more of the tables are used together, as will be discussed in more detail below, one or more of the legs of the table can be pivoted to maximize the available seating or for other purposes, e.g., for accessibility or for aesthetics.

Figure 1:
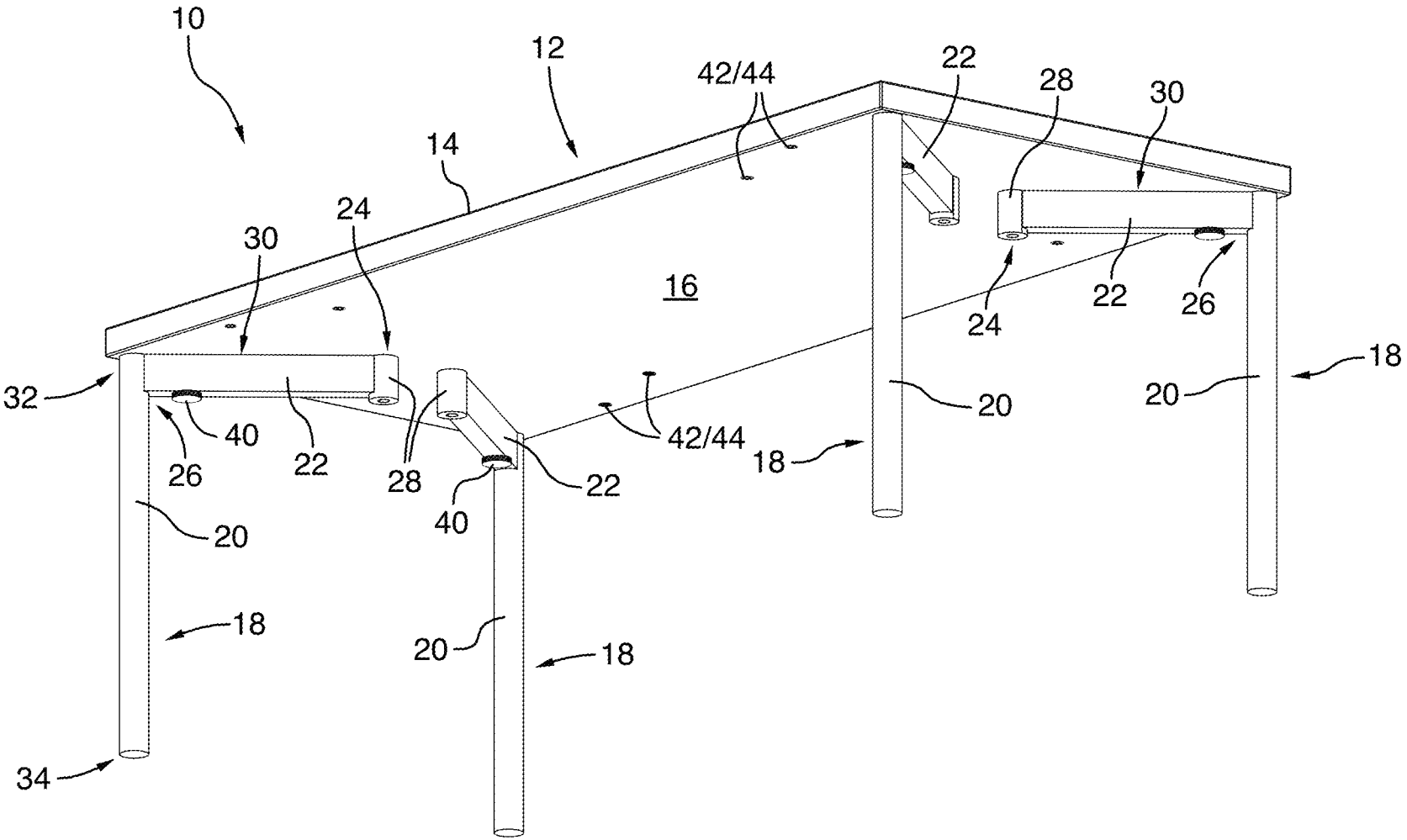
FIG. 1 is a perspective view, taken from below, of a table according to one implementation, with the pivoting legs of the table in a first position.
Figure 1A:
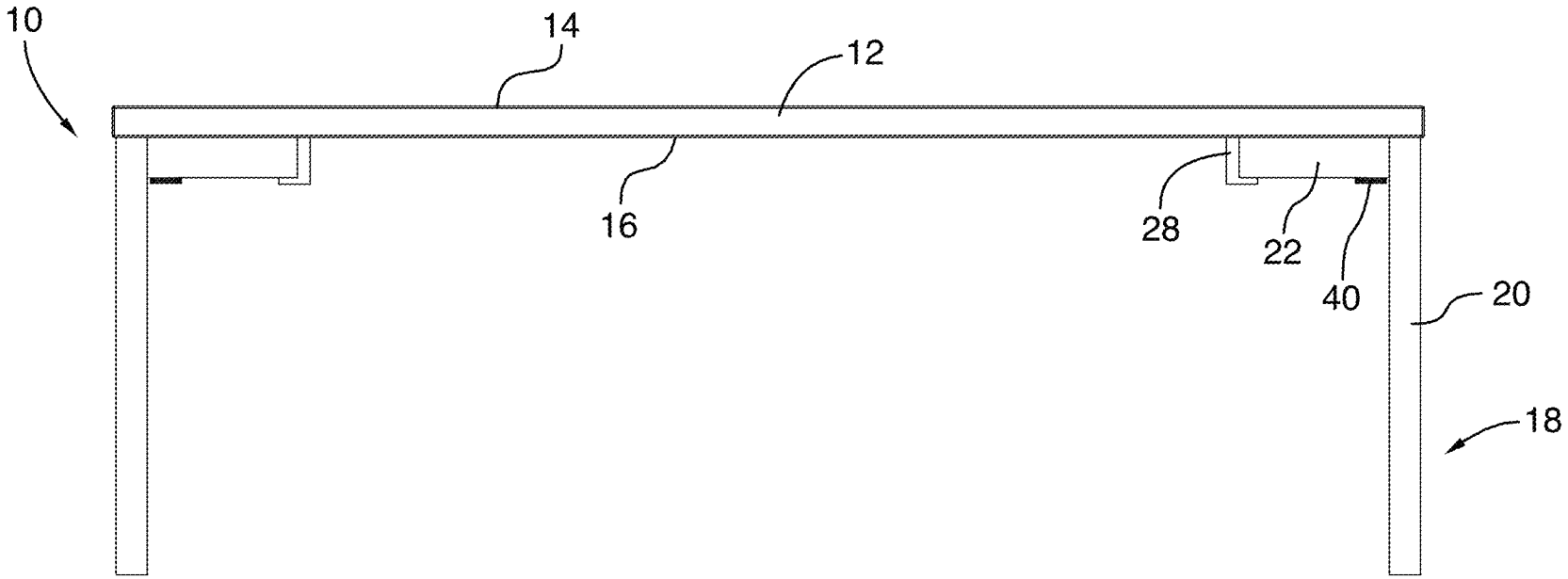
FIG. 1A is a side plan view of the table as shown in FIG. 1.
Figure 1B:
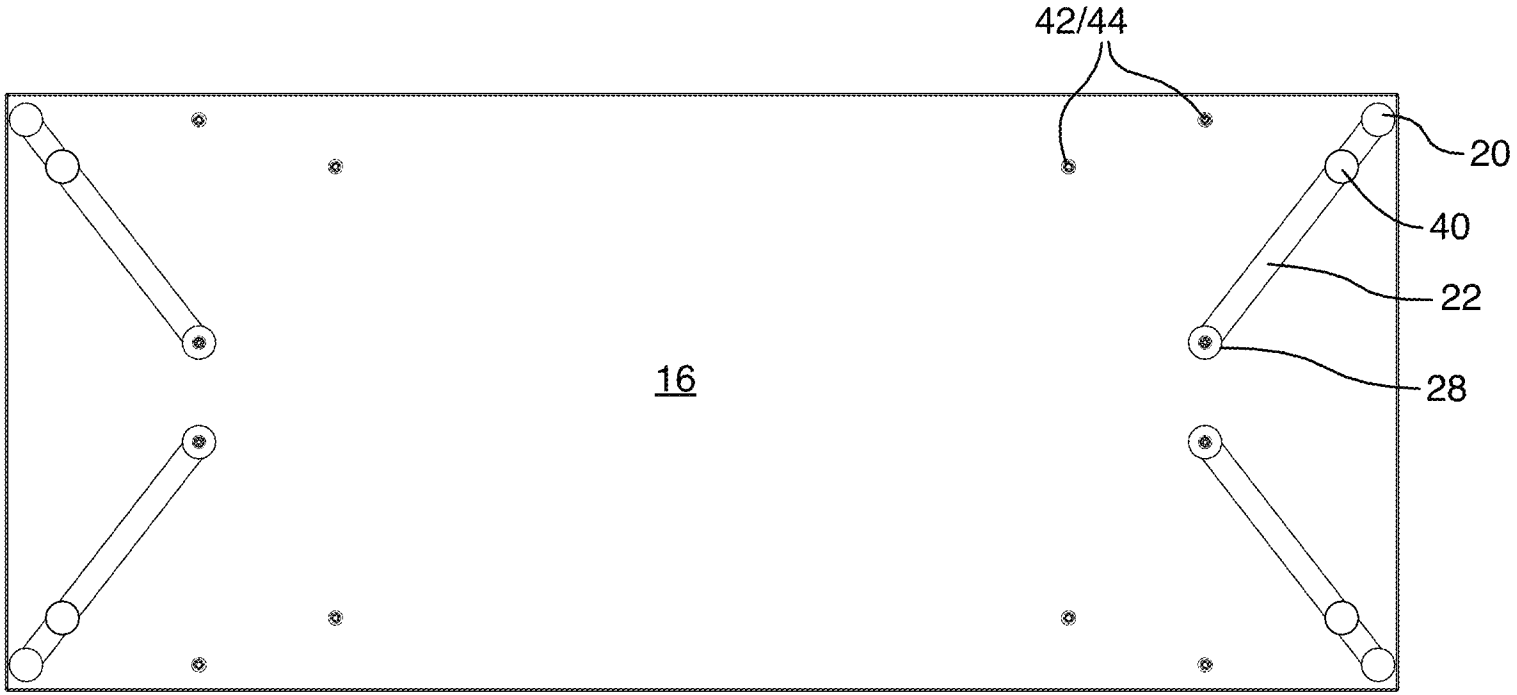
FIG. 1B is a bottom plan view of the table as shown in FIG. 1.

Referring to FIG. 1, a table 10 includes a table top 12 having an upper surface 14 and a lower surface 16. Generally, both surfaces are substantially planar, exclusive of any surface texture or ornamentation. Table 10 also includes four legs 18, each of which includes a vertical leg portion 20 and a horizontal elongated support arm 22. Each support arm 22 is pivotably mounted to the lower surface 16 at a proximal end 24 and joined to the vertical leg portion 20 at a distal end 26. Each proximal end 24 includes a cylindrical portion 28 at the proximal end 26. A pivoting mechanism, shown in detail in FIGS. 7 and 8 and described below, is disposed in each of the cylindrical portions, allowing the support arm 22 to pivot about an axis A (FIG. 6).

Figure 6:
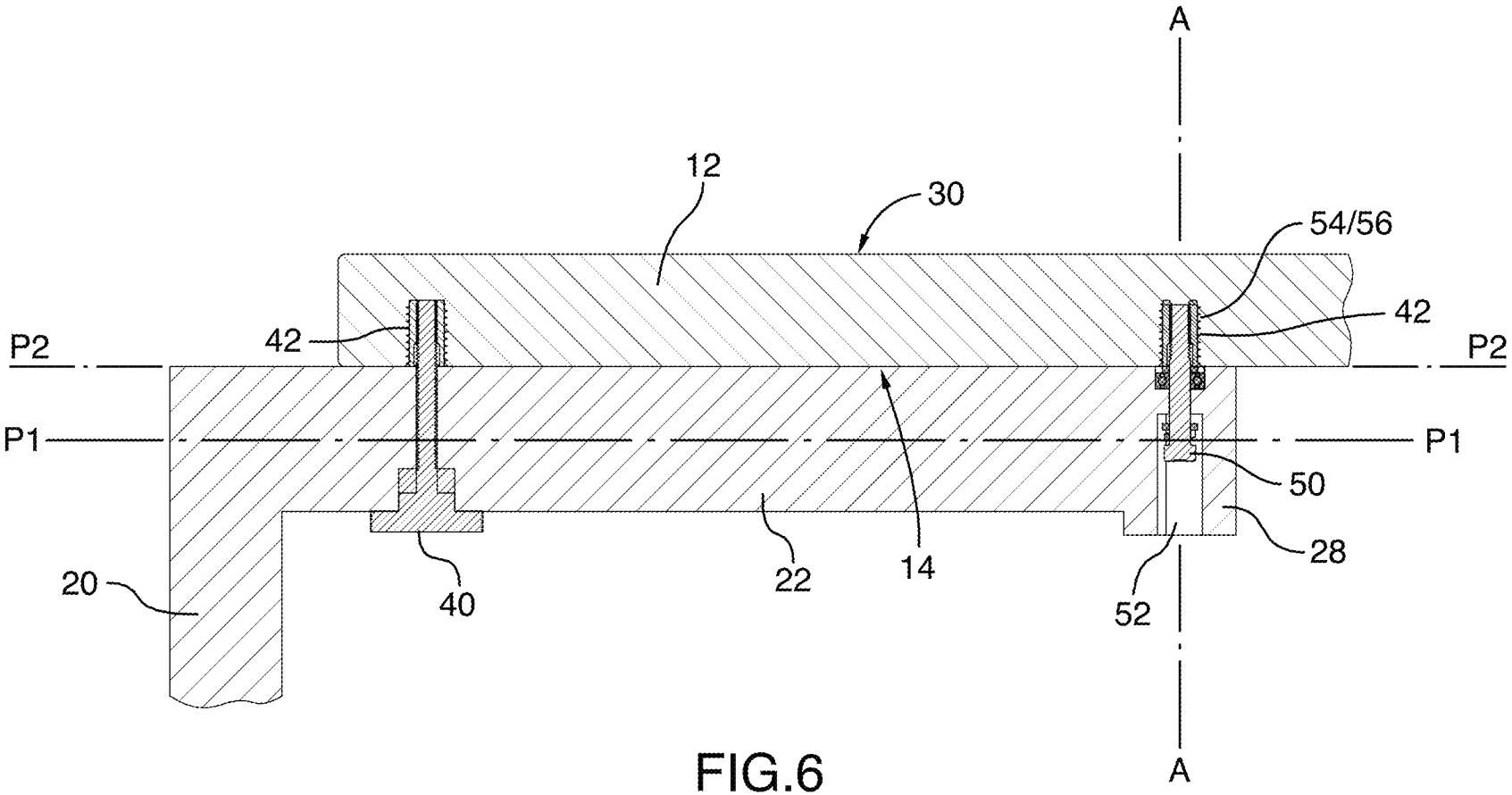
FIG. 6 is a cross-sectional view of pivoting and fastening mechanisms according to one implementation.

Each support arm 22 is disposed in a plane that is generally parallel to a plane defined by the lower surface, as can be seen in FIG. 6 (planes P1 and P2). Each support arm 22 also includes an upper surface 30 that is configured to contact and support the lower surface 16 of the table top 12.

Each vertical leg portion 20 extends from a proximal end 32 adjacent the lower surface 16 of the table top to a distal end 34 configured to contact a floor surface to support the table top at a predetermined distance from the floor surface. The proximal end of the vertical leg portion is mounted on the distal end of the support arm 22 such that the vertical leg portion pivots with the support arm, changing the orientation of the vertical leg portion relative to the table top when the vertical leg portion is oriented generally perpendicular to the table top (i.e., the leg is not being folded onto the underside of the table top, as is the case in conventional folding tables, but instead its position supporting the table top is being adjusted).

Figure 2:
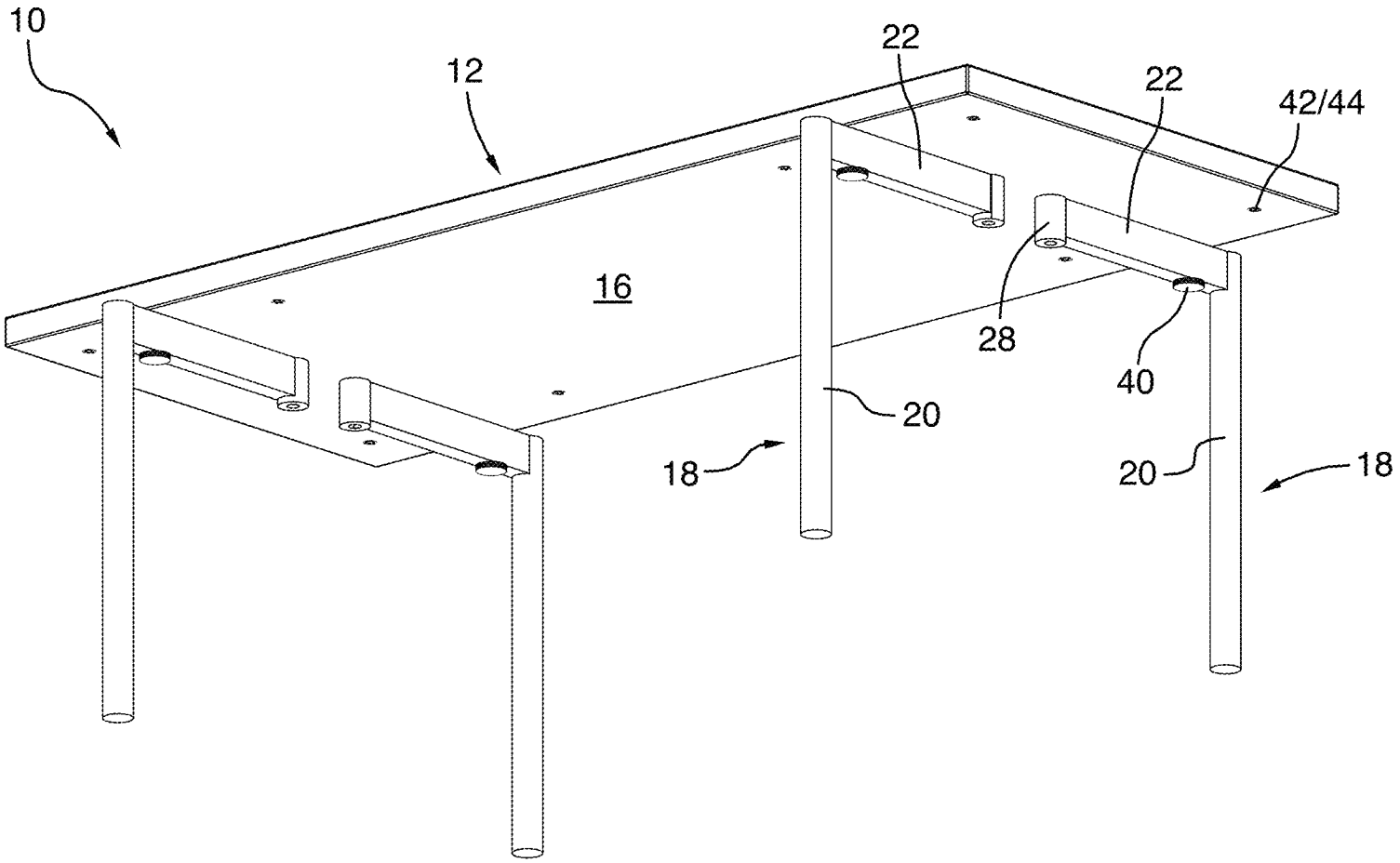
FIG. 2 is a perspective view, taken from below, of the table shown in FIG. 1, with the pivoting legs of the table in a second position.
Figure 2A:
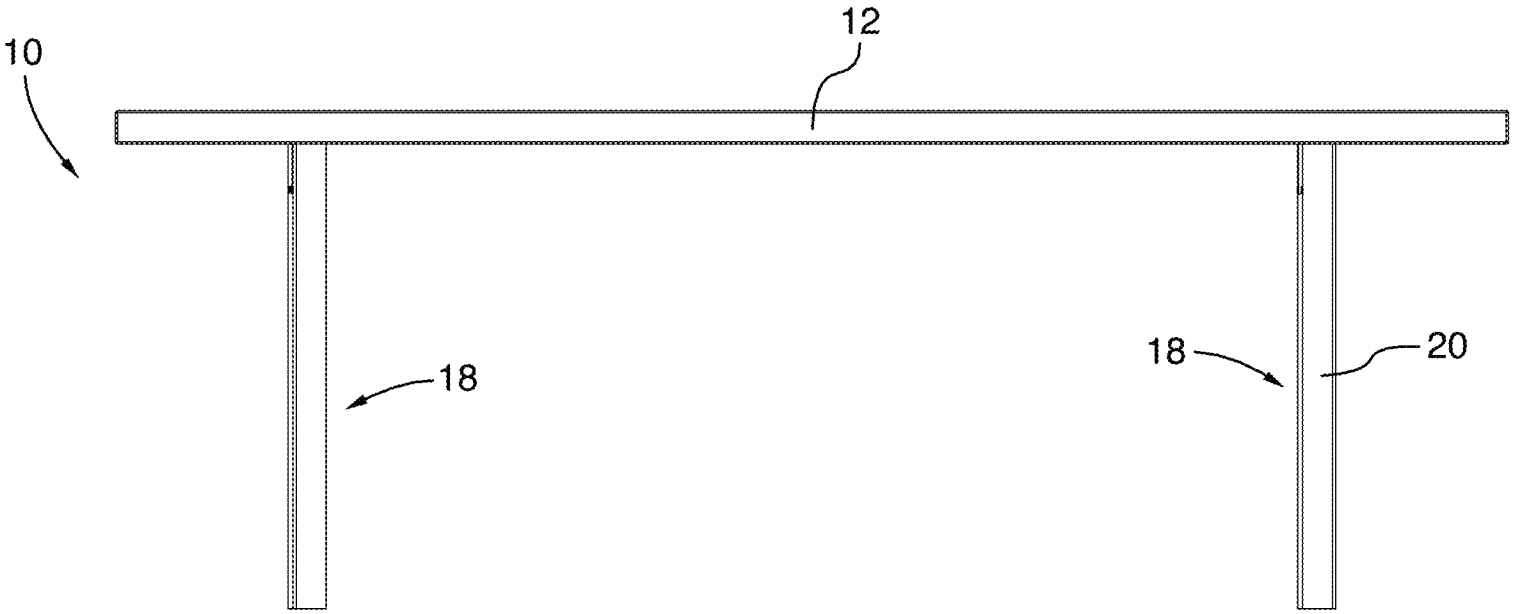
FIG. 2A is a side plan view of the table as shown in FIG. 2.
Figure 2B:
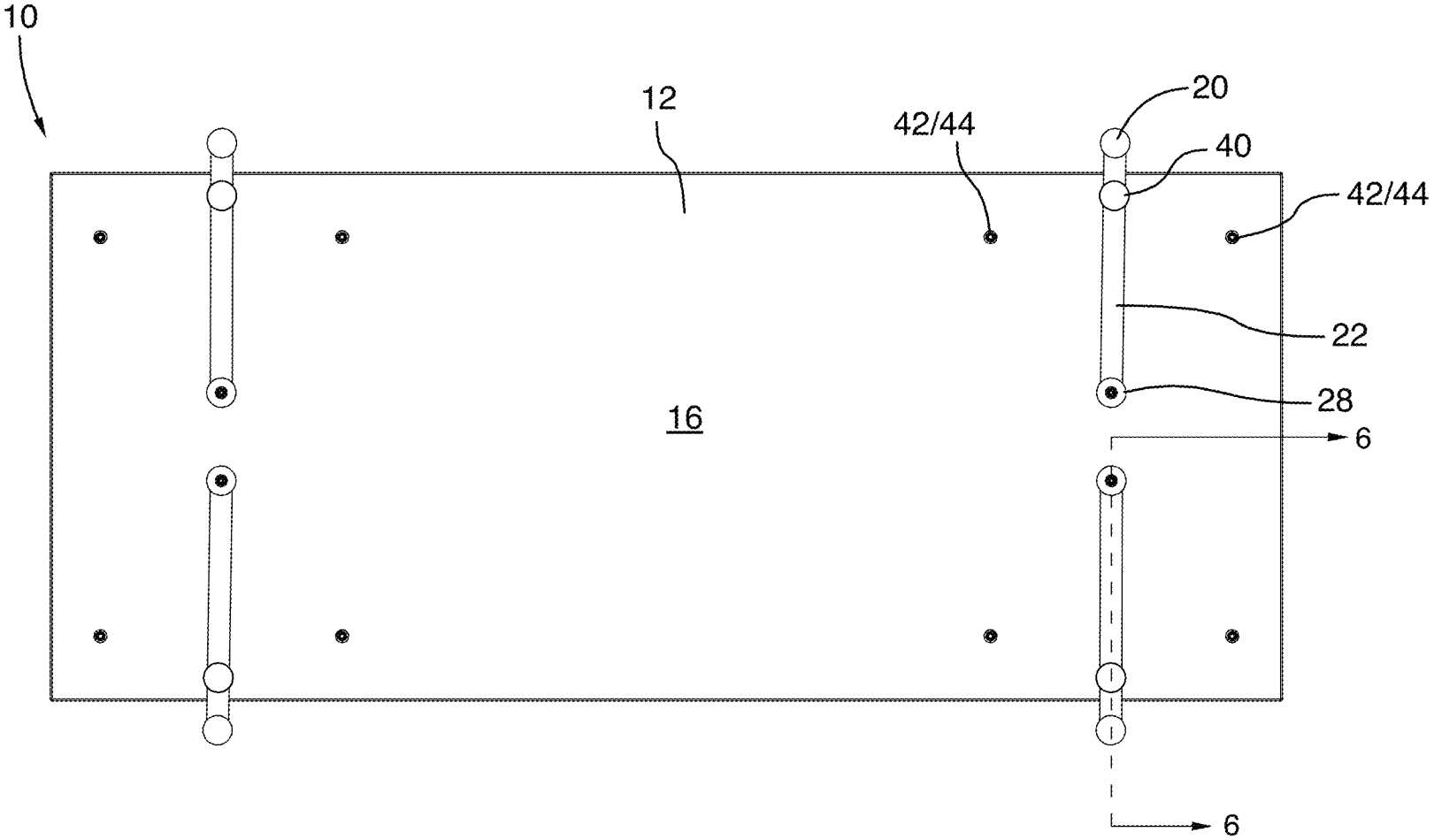
FIG. 2B is a bottom plan view of the table as shown in FIG. 2.
Figure 3:
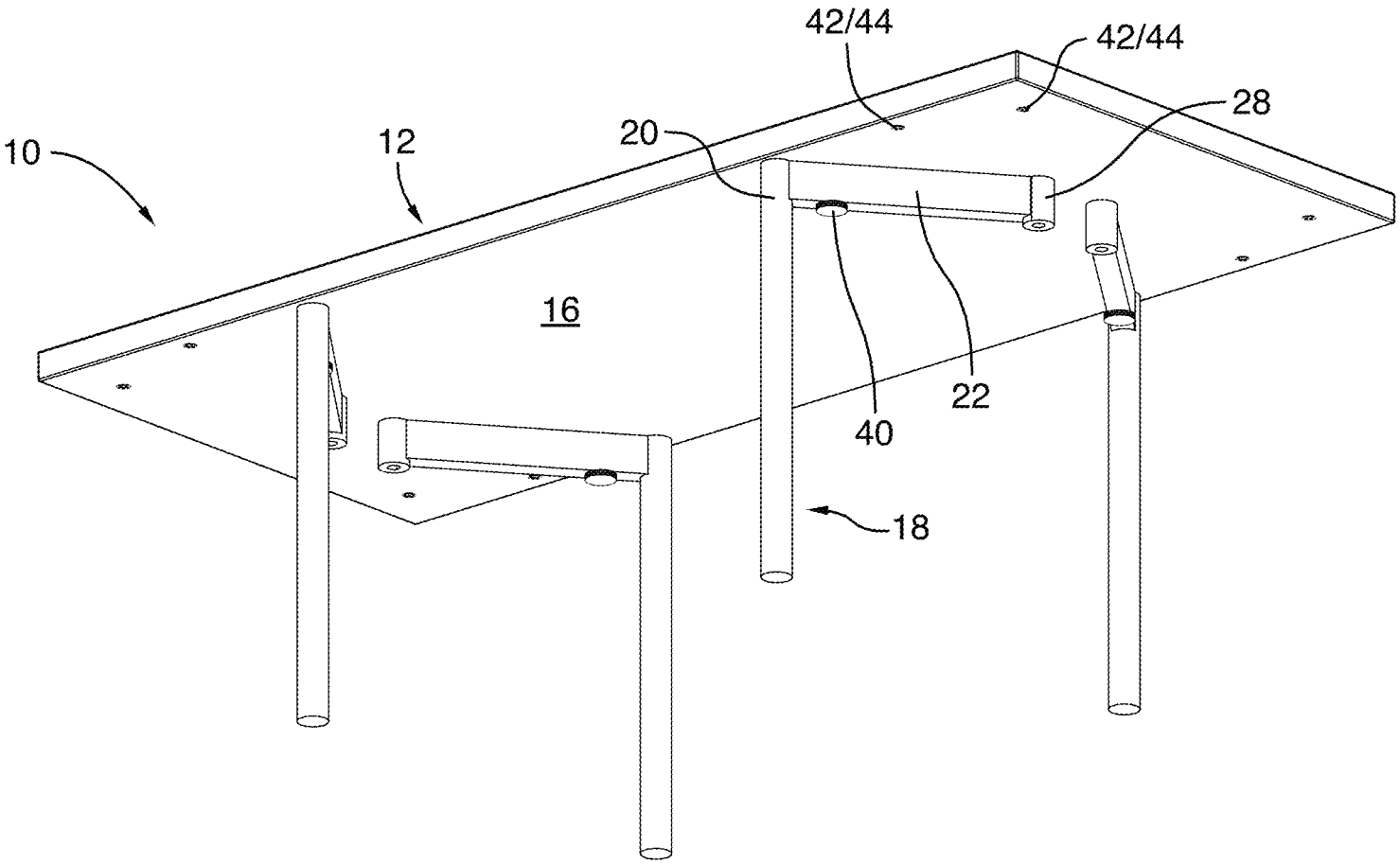
FIG. 3 is a perspective view, taken from below, of the table shown in FIG. 1, with the pivoting legs of the table in a third position.
Figure 3A:
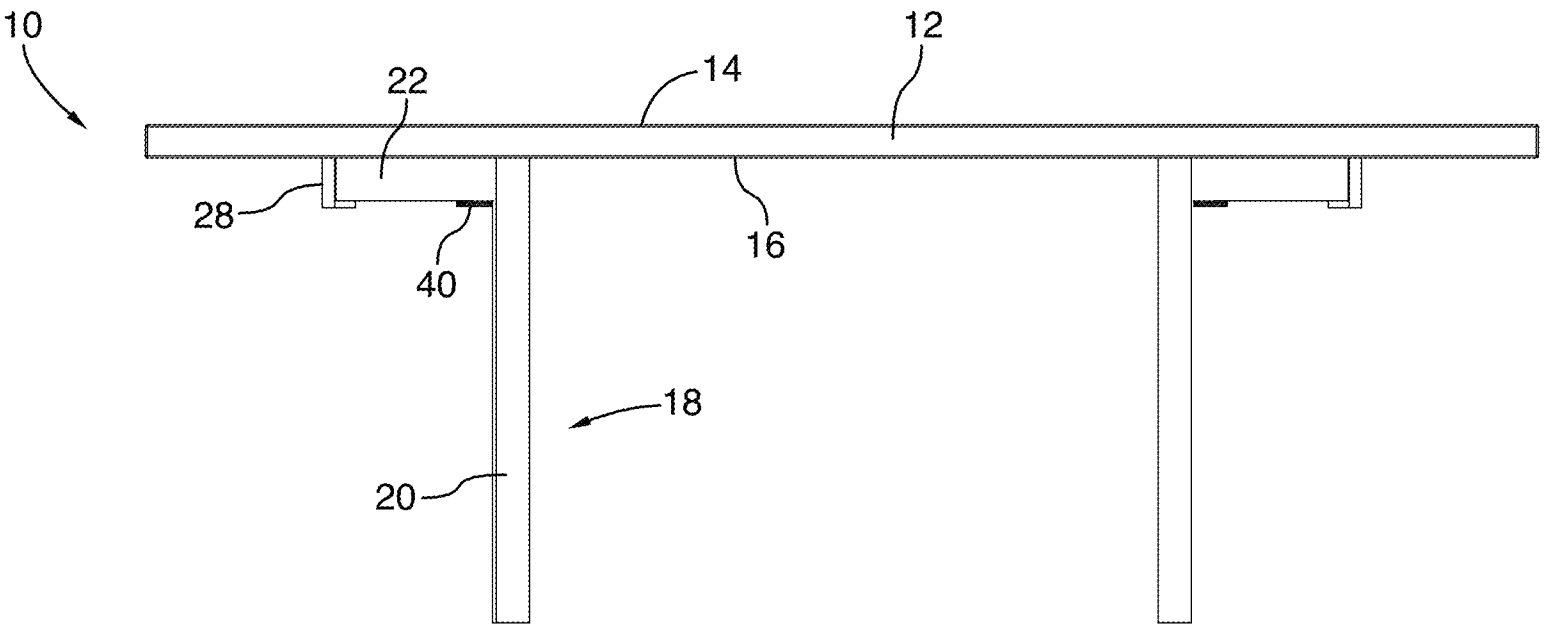
FIG. 3A is a side plan view of the table as shown in FIG. 3.
Figure 3B:
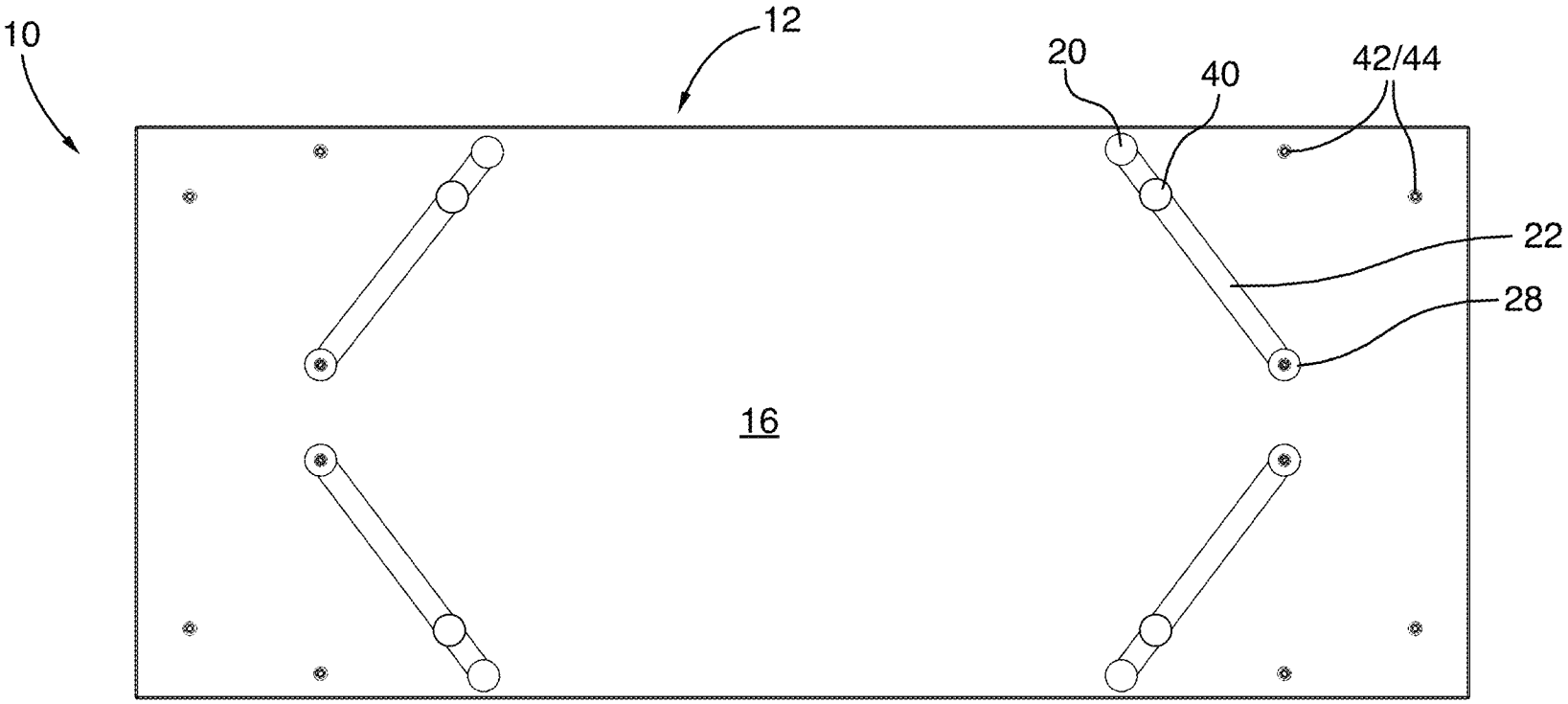
FIG. 3B is a bottom plan view of the table as shown in FIG. 3.
Figure 4:
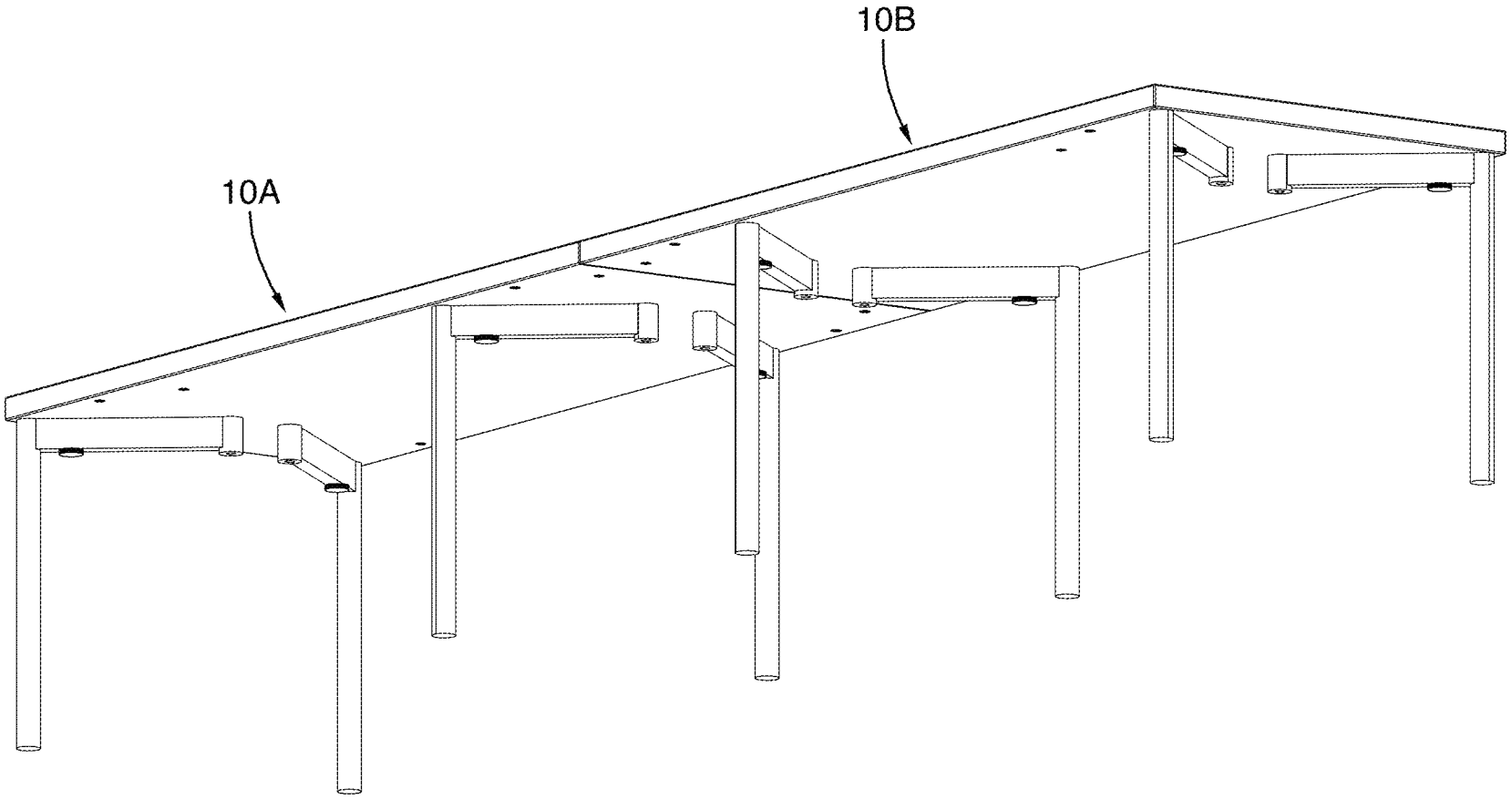
FIG. 4 is a perspective view of a pair of tables of the implementation shown in FIG. 1 arranged together end to end.
Figure 5:
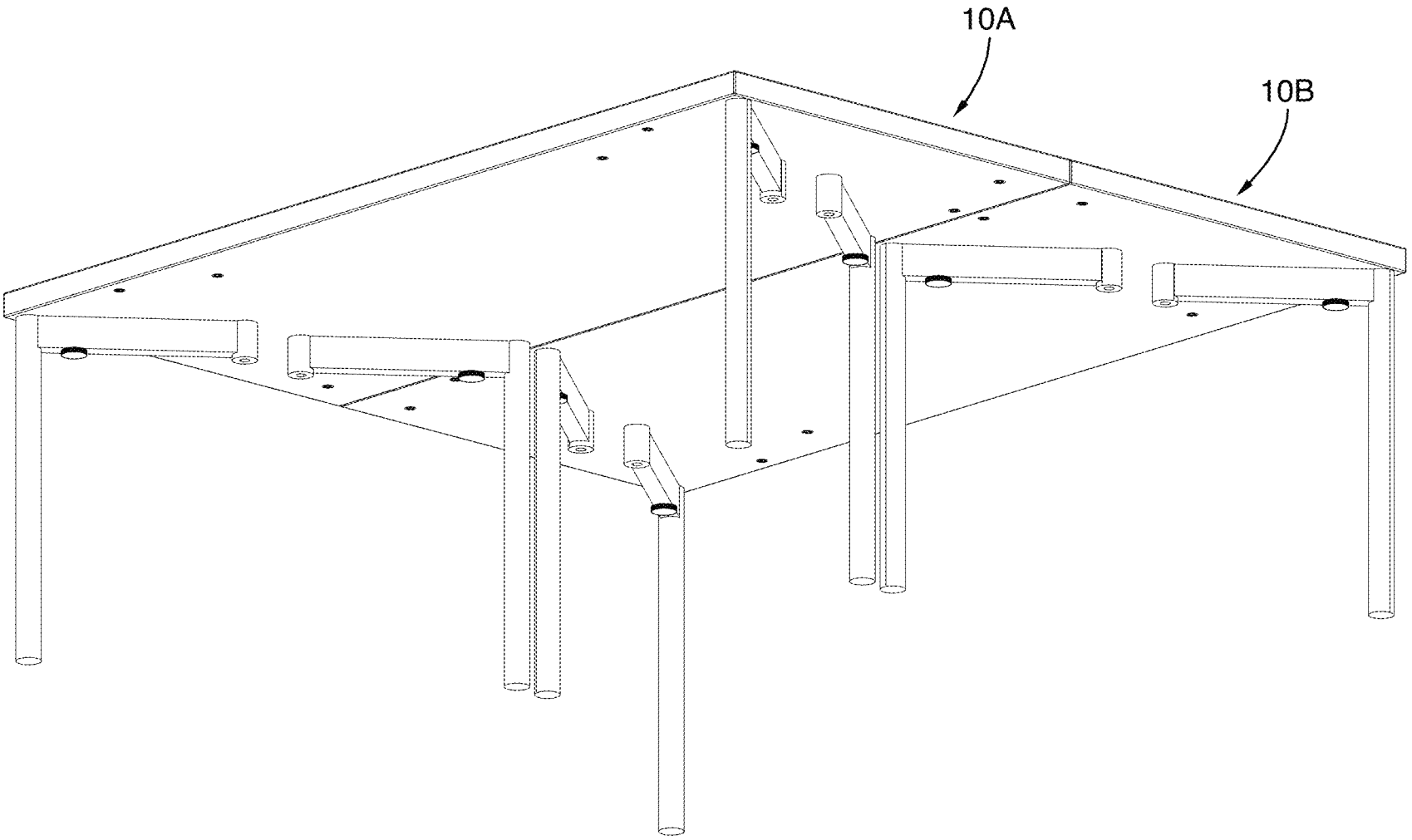
FIG. 5 is a perspective view of a pair of tables of the implementation shown in FIG. 1 arranged together side by side.

In the example shown in FIGS. 1-3B the orientation of the legs can be adjusted between three predetermined positions and the legs fixed in place in these positions. The legs are independently pivotable, to allow for a large number of possible configurations, of which only three are shown in FIGS. 1, 2 and 3. For the sake of simplicity in the illustrated configurations all of the legs have been pivoted to the same position in FIGS. 1-3. Examples of multi-table configurations in which this is not the case are shown in FIGS. 4 and 5.

The legs may be fixed in the predetermined positions using any desired mechanism. Referring to FIGS. 5 and 6, in the implementation shown in FIGS. 1-3B, the legs are fixed in place by the interaction of a position thumb screw 40 with one of a plurality of threaded inserts 42 positioned in openings 44 in the lower surface 16. If desired, the position of the leg can be easily adjusted simply by lifting the distal end of that leg very slightly off the floor surface, loosening the thumb screw 40 just enough to back it out of the opening 44, pivoting the leg 18 to the desired new position, and advancing the thumb screw 40 into the new opening 44. There is no need to turn the table over or lift the entire table, which is particularly advantageous if the table is large and heavy (for example a large wood dining table). Moreover, pivoting is guided and controlled by the support arm 22 allowing easy location of the thumb screw in the desired opening.

Figure 7:
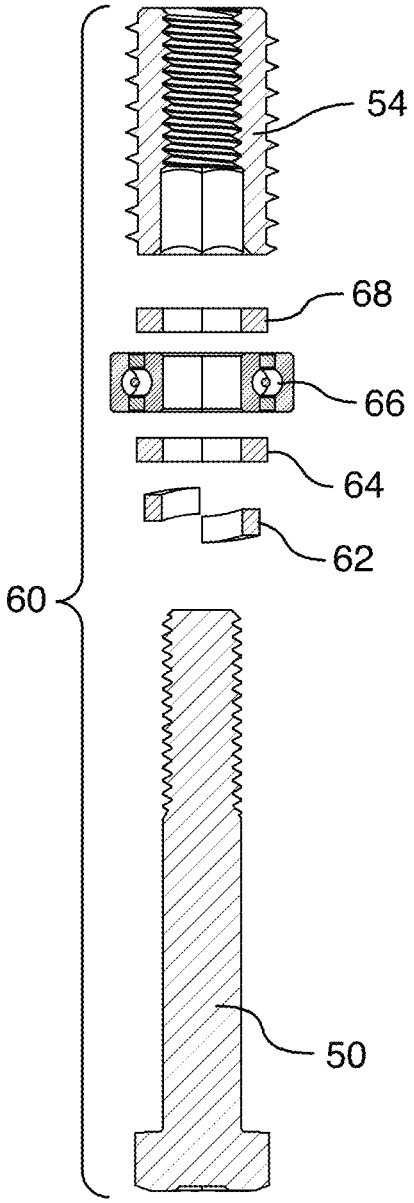
FIG. 7 is an exploded view of the pivoting mechanism shown in FIG. 6.
Figure 8:
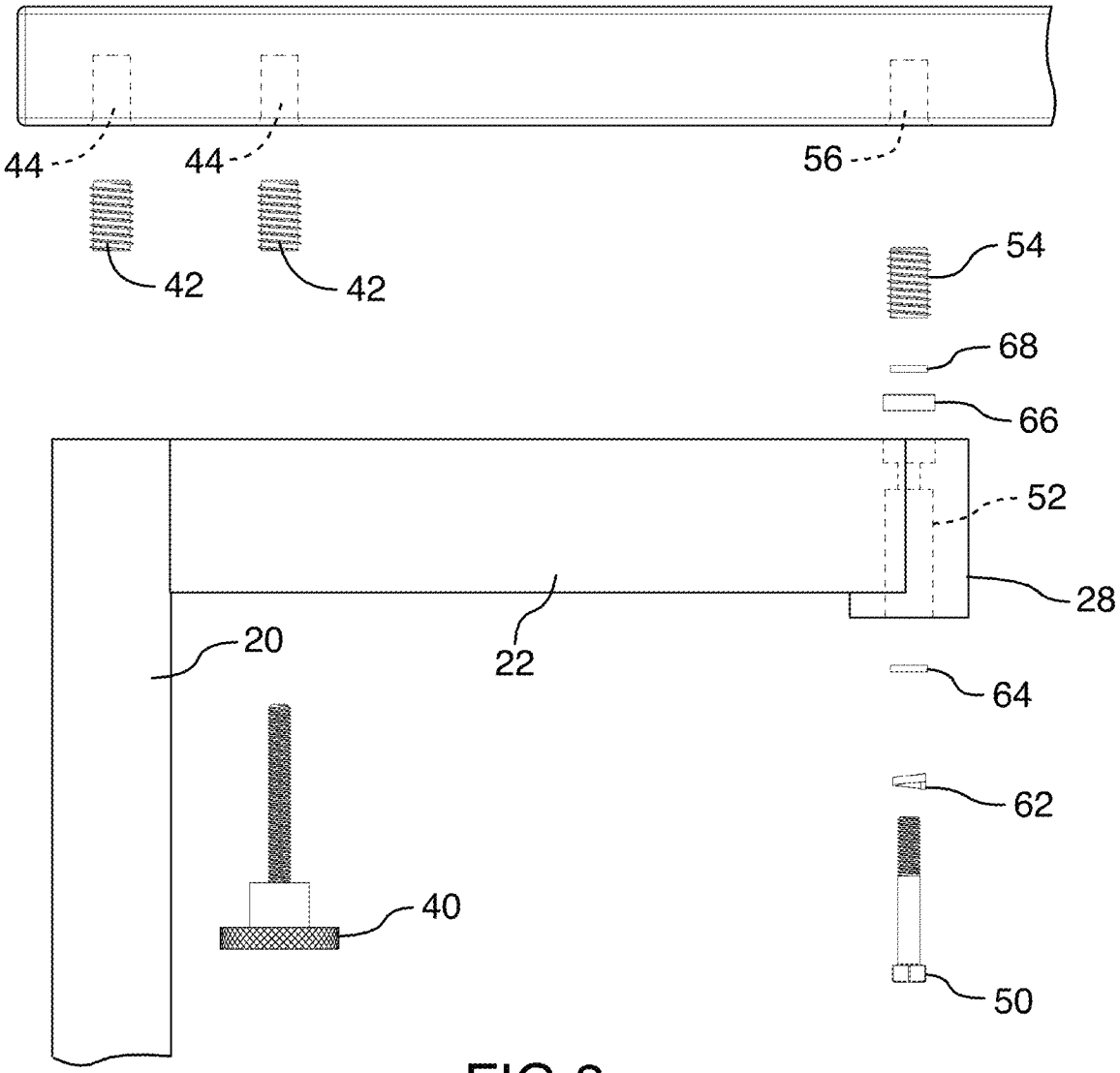
FIG. 8 is a diagrammatic exploded view of the pivoting and fastening mechanisms shown in FIG. 6.

While various types of pivoting mechanisms can be used, an example of a suitable mechanism is shown in FIGS. 6-8. As can be seen in FIG. 6, the mechanism includes a hinge bolt 50 inserted into a countersunk bore 52 in the cylindrical portion 28 and threaded into a threaded insert 54 disposed in an opening 56 in the lower surface 16 of the table top. Referring now to FIGS. 7 and 8, the pivoting mechanism 60 (FIG. 7) also includes, to ensure smooth pivoting, a lock washer 62, a lower washer 64, a bearing sleeve 66, and an upper washer 68.

Referring again to FIGS. 4 and 5, the pivoting legs described above allow multiple tables (e.g., the illustrated tables 10A and 10B) to be configured in a variety of different ways, for example end to end as shown in FIG. 4 or side by side as shown in FIG. 5. The pivoting legs can be adjusted so that the vertical leg portions 20 of the legs are not in the way of people seated at the tables, optimizing the amount of seating space provided by the table arrangement. This can be advantageous for large dinner parties, business meetings, etc., and allows the tables to be easily reconfigured and used separately for smaller groups.

Figure 9:
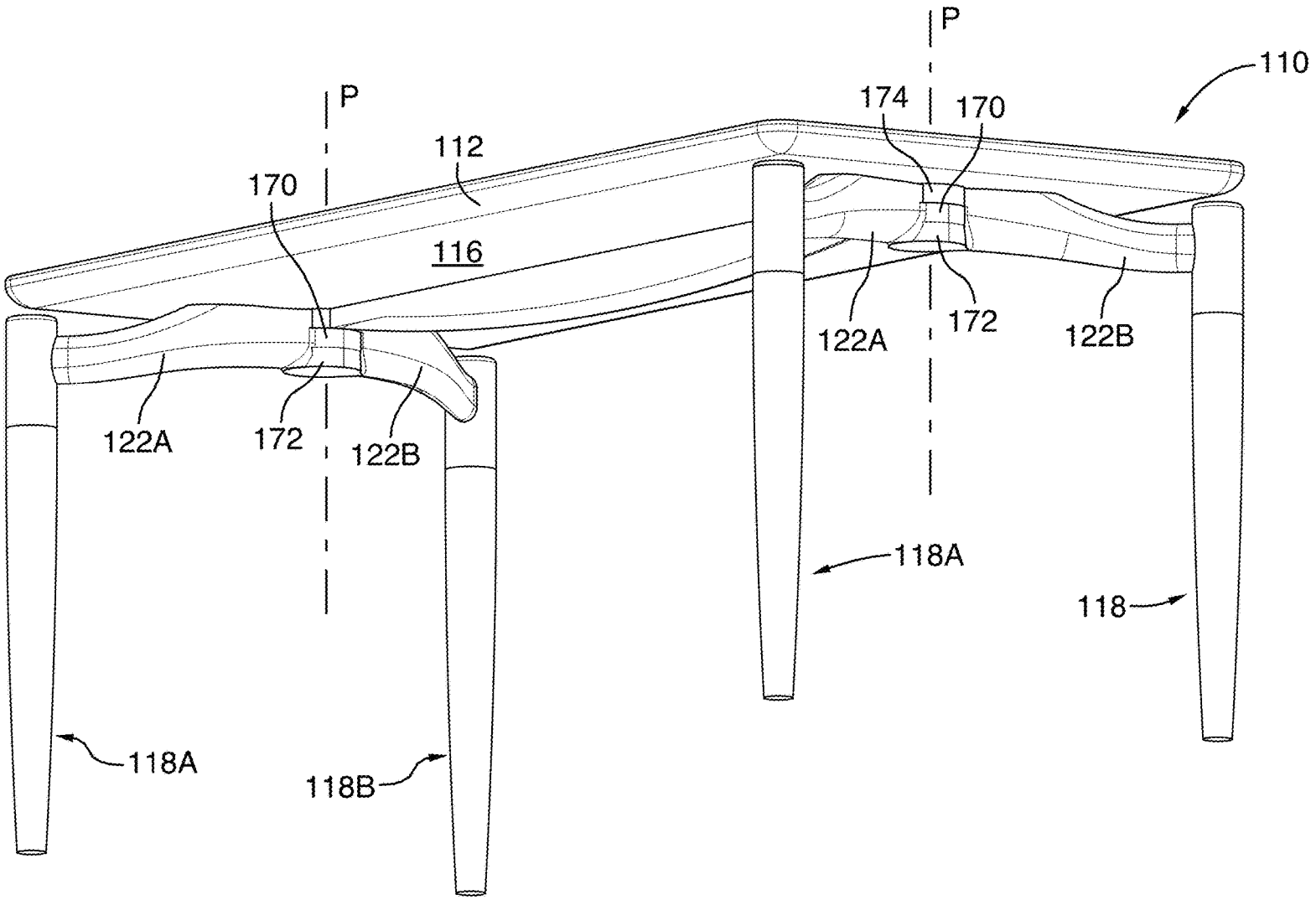
FIG. 9 is a perspective view of a table according to an alternative implementation.
Figure 9A:
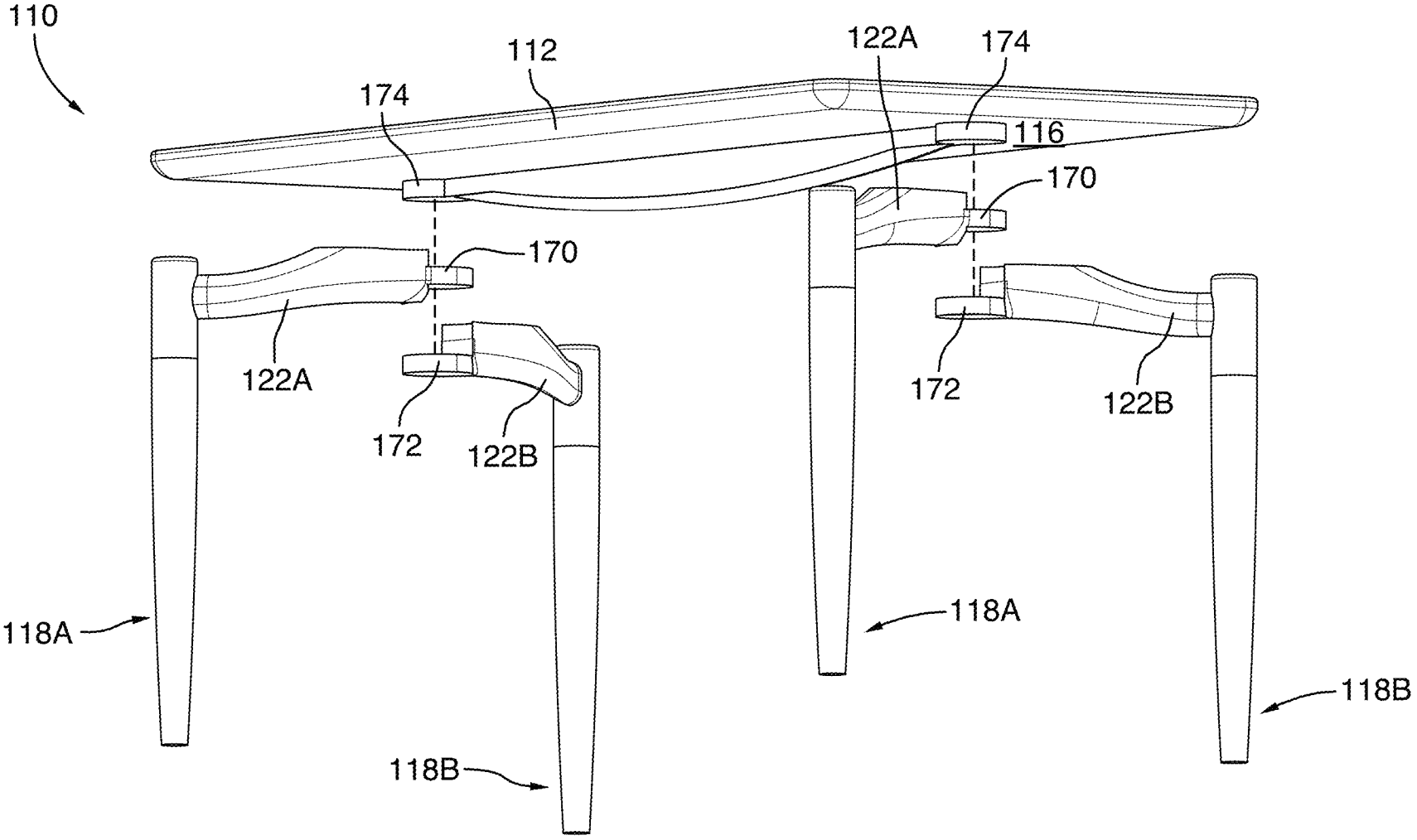
FIG. 9A is a perspective view of the table shown in FIG. 9 with the pivoting legs exploded.
Figure 9B:
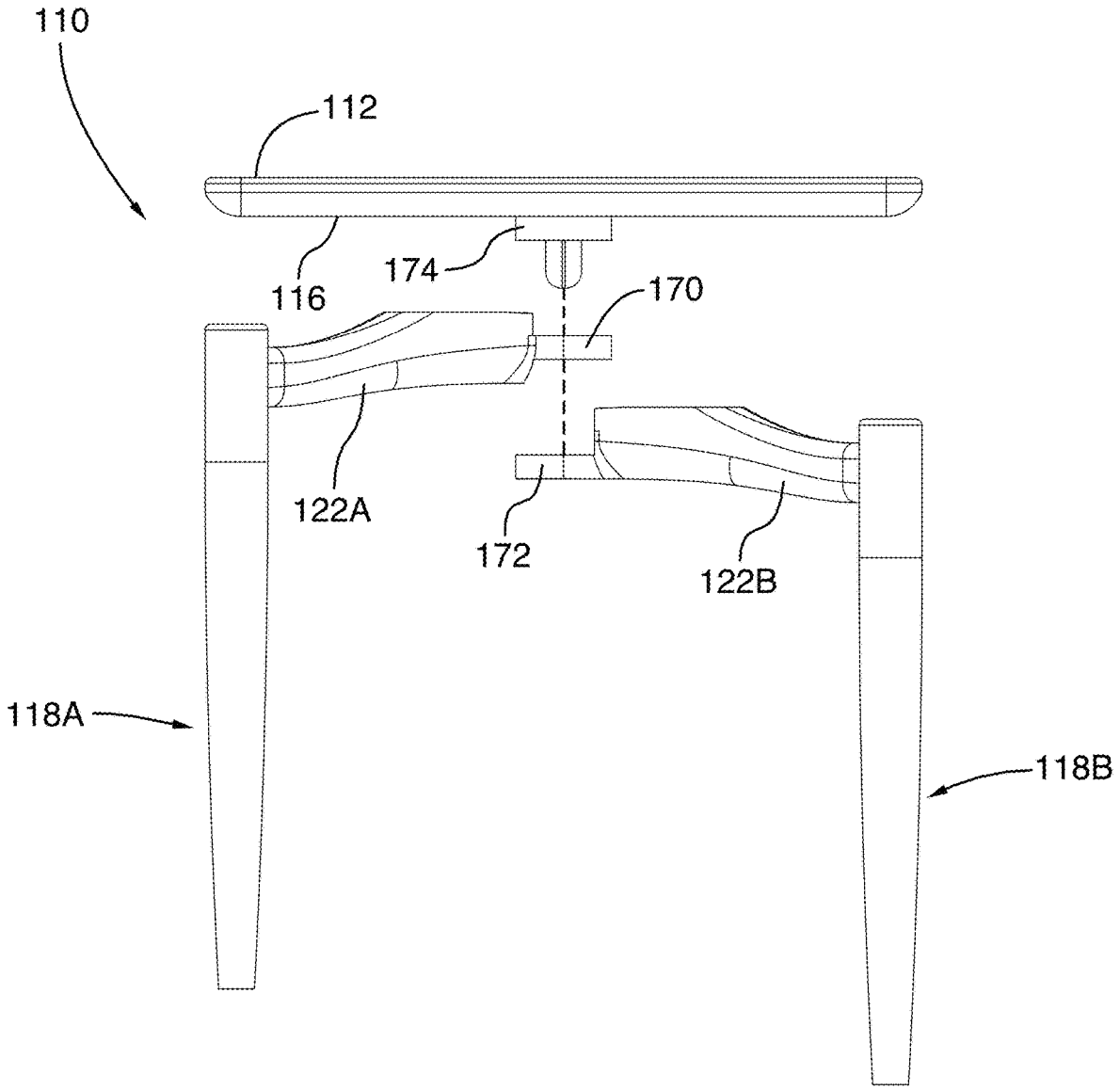
FIG. 9B is a side plan view of the table as shown in FIG. 9A.

Referring to FIGS. 9-9B, in a table 110 according to an alternative embodiment two legs 118A, 118B can be arranged to pivot about a common pivot axis P. This common-axis pivoting can be accomplished in various ways. In the illustrated implementation, as shown in FIGS. 9A and 9B, the proximal ends of the support arms 122A, 122B include tongues 170, 172 that are configured to fit together as shown in FIG. 9. The tongues 170, 172 include through bores (not shown), and are positioned under a cylindrical element 174 that extends from the lower surface 116 of the table top 112. Cylindrical element 174 includes an opening with a threaded insert (not shown) similar to the opening/insert 54/56 shown in FIG. 6. The remainder of the pivoting mechanism shown in FIG. 7 may be disposed in the aligned bores of tongues 170, 172, or any desired pivoting mechanism may be provided.

Figure 10:
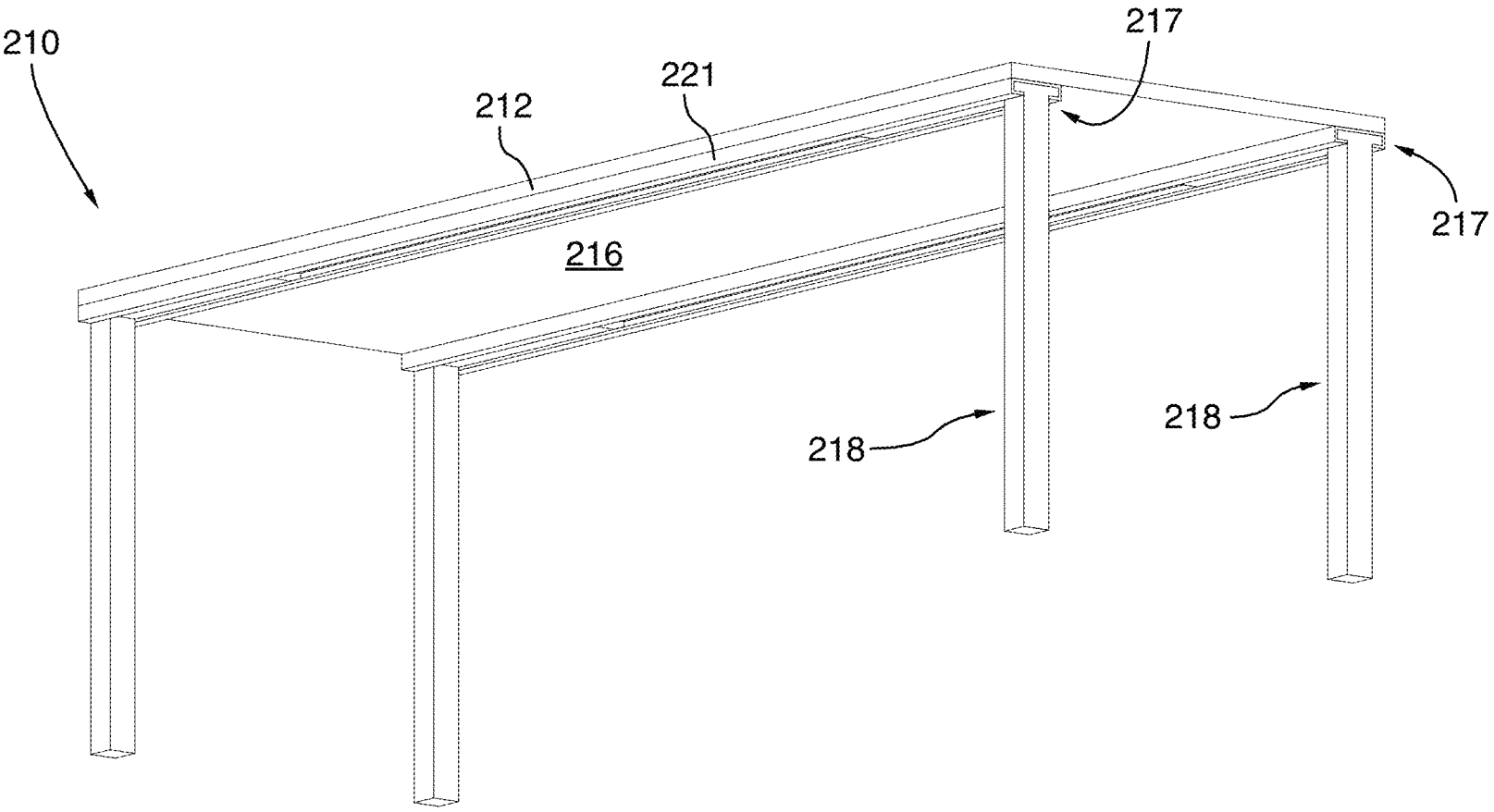
FIG. 10 is a perspective view, taken from below, of a table according to a second implementation, with sliding legs of the table in a first position.
Figure 10A:
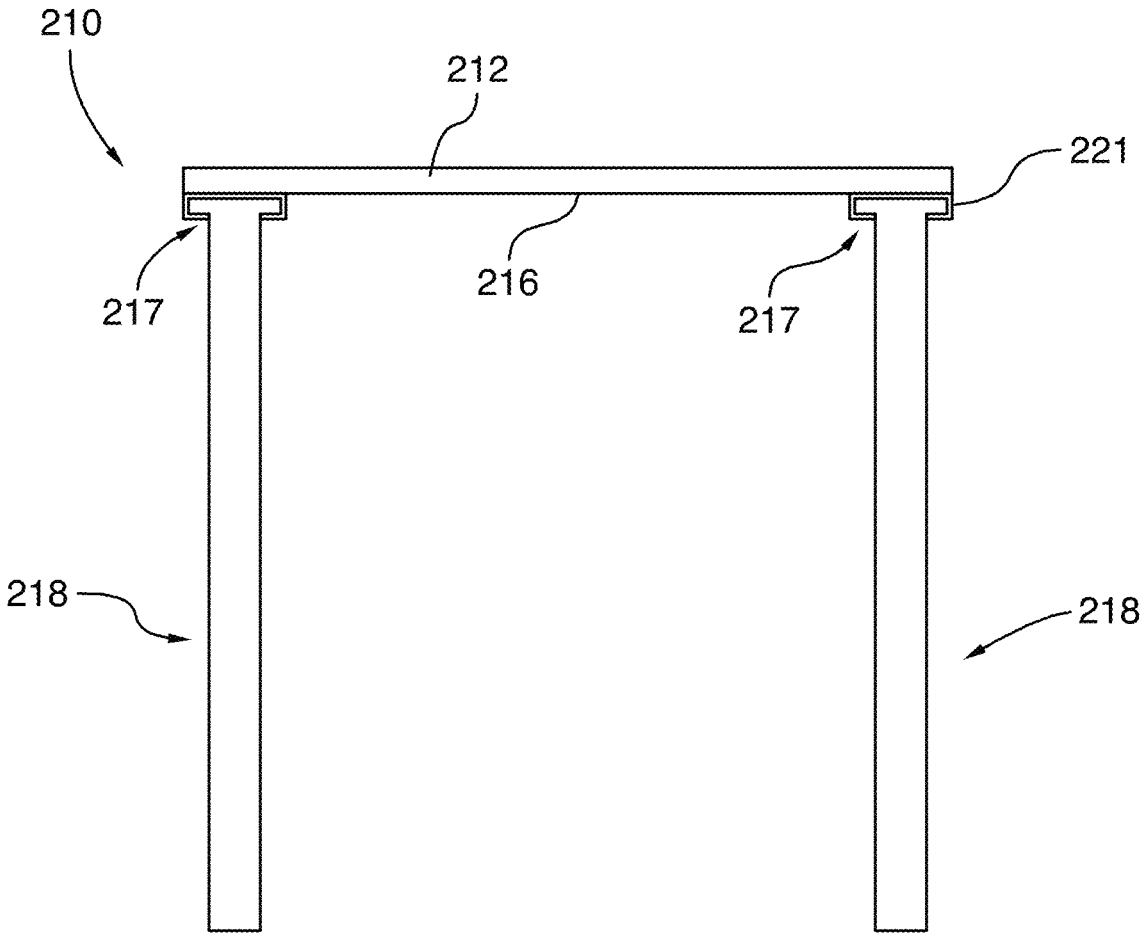
FIG. 10A is a side plan view of the table as shown in FIG. 10.
Figure 11:
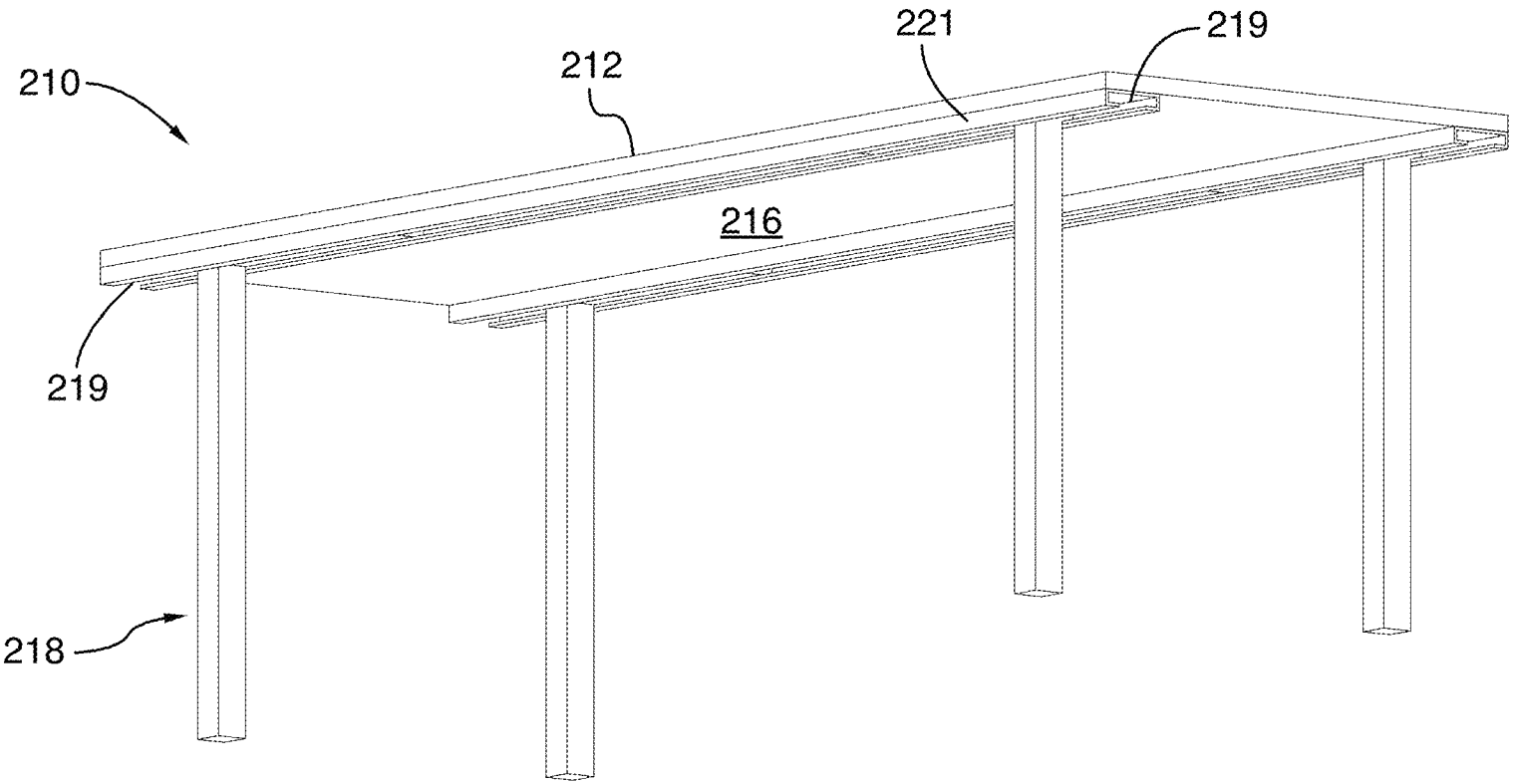
FIG. 11 is a perspective view, taken from below, of the table shown in FIG. 10, with the sliding legs of the table in a second position.
Figure 12:
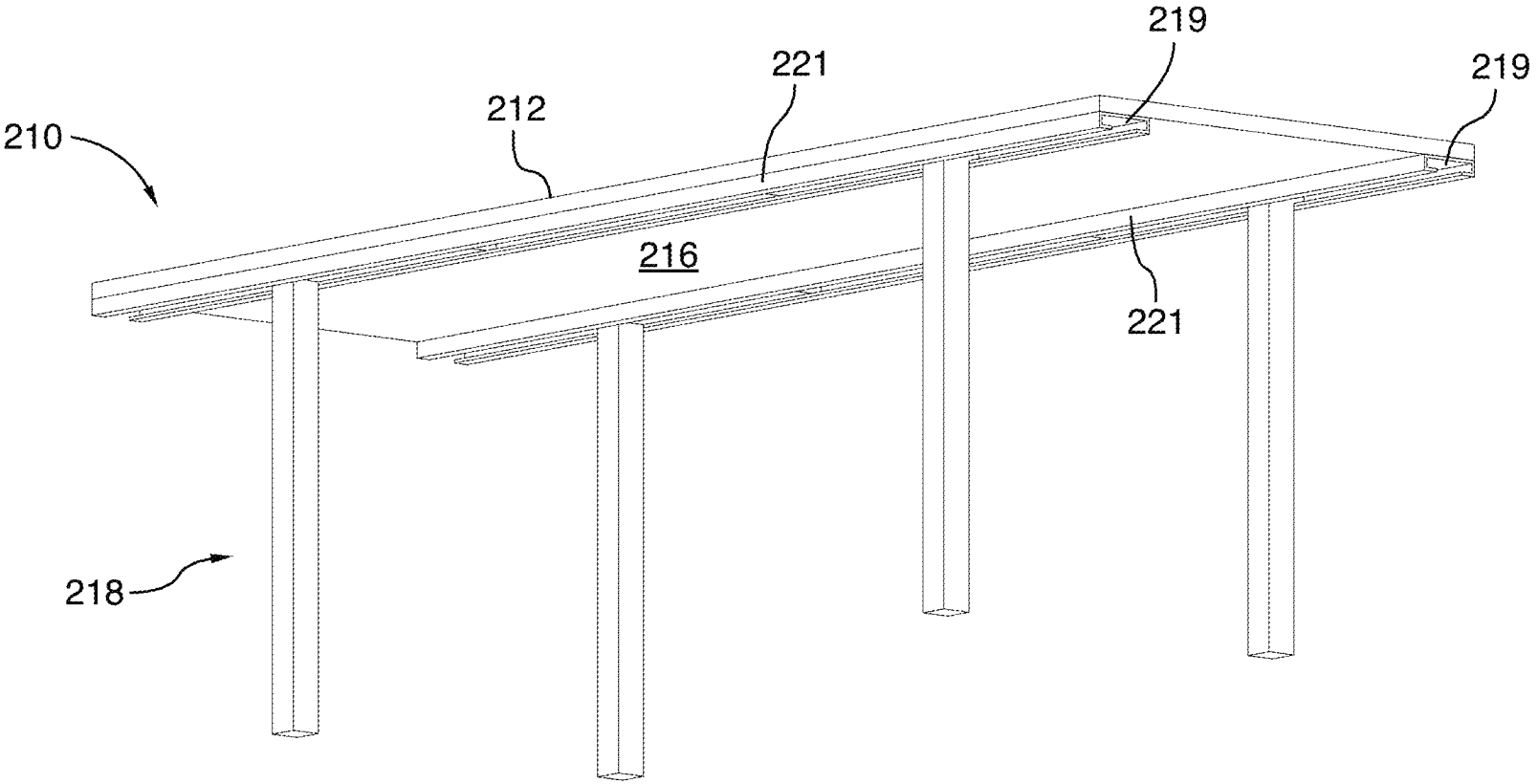
FIG. 12 is a perspective view, taken from below, of the table shown in FIG. 10, with the sliding legs of the table in a third position.

Referring now to FIGS. 10-12, in a table 210 according to another embodiment the orientation of the vertical leg portions can be changed by sliding rather than pivoting movement. In this embodiment the legs 218 do not include a support arm. Instead, the proximal end 217 of each leg is generally T-shaped in cross-section, allowing it to be retained in a groove 219 (FIG. 11) that is generally C-shaped provided in a channel element 221 mounted on lower surface 216 of the table top 212. This engagement of the proximal end 217 in the groove 219 allows the leg 218 to slide along the groove 219 when the leg is unweighted by lifting the distal end of the leg slightly off of the floor surface. If desired, the leg can be locked into one of multiple pre-set positions with a push-button telescoping tube lock (also known as a ball catch or button clip), a threaded knob insert, a quick release ball lock pin, or any other desired locking mechanism. Alternatively, the leg can be allowed to slide to any desired position along the groove and held in place simply by the weight of the table.

Other Embodiments

A number of embodiments have been described. Nevertheless, it will be understood that various modifications may be made without departing from the spirit and scope of the disclosure.

For example, while the planar element shown in the figures has completely planar top and bottom surfaces, in some cases ornamental or functional features might be included that would disrupt the surface of the plane. For example, the bottom surface of the table top could be rough hewn wood. The bottom surface need only be sufficiently locally planar to allow pivoting of the legs and the upper surface need only be sufficiently planar to accommodate the intended use of the table.

Additionally, while the tables shown in the drawings are rectangular, the features described herein can also be used with tables having other geometric shapes.

Also, while FIGS. 1-3B show an embodiment in which pivoting legs can be moved between three fixed positions, in other embodiments a greater or smaller number of positions can be used.

Figure 13:
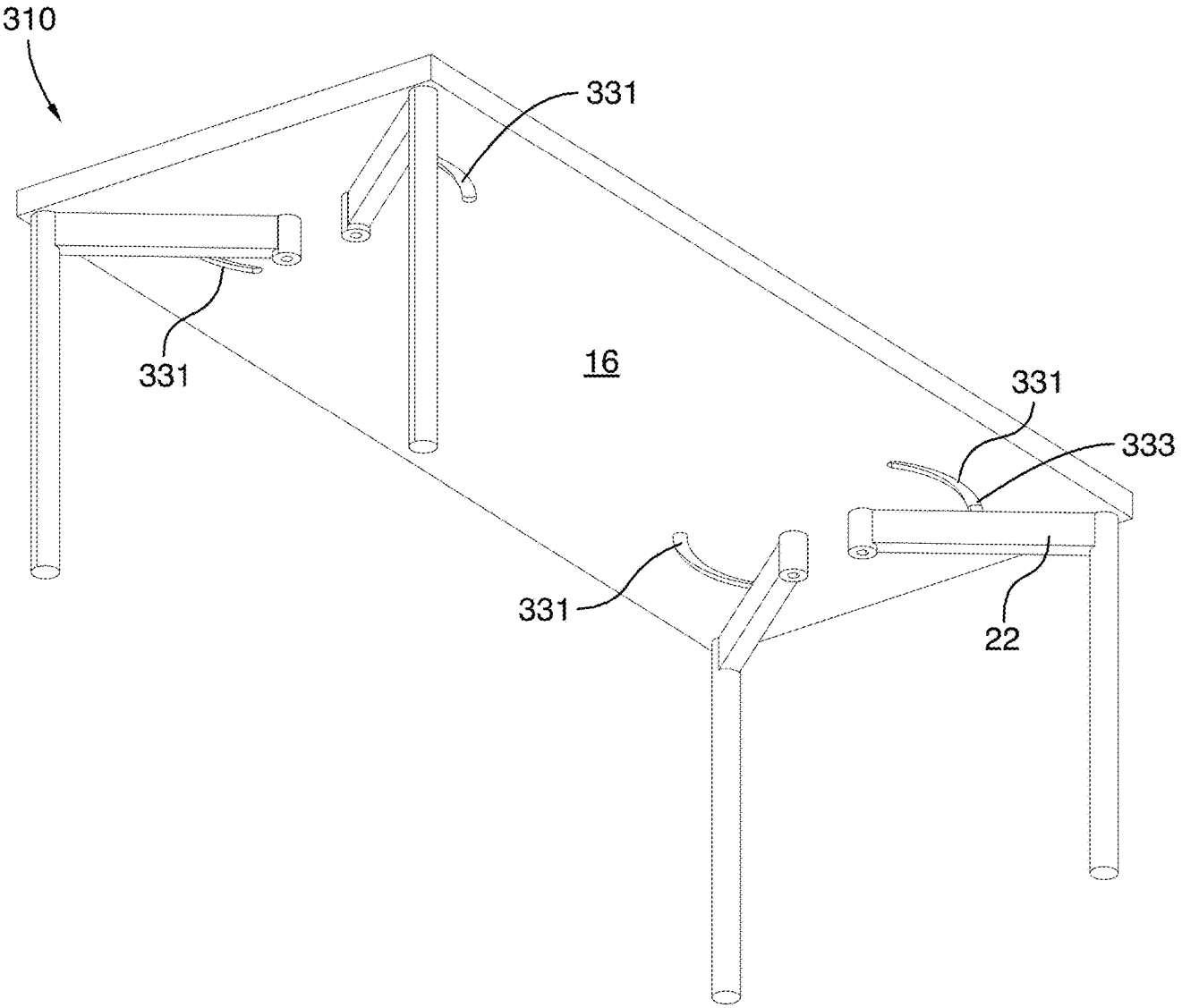
FIG. 13 is a perspective view, taken from below, of a table according to another alternative implementation.

To provide additional adjustability, as shown in FIG. 13 a table 310 can include arcuate grooves 331 in which protrusions 333 (of which only one is visible) extending from arms 22 are slidably engaged. The arcuate grooves replace the openings 44 discussed above and allow the legs to be pivoted to any point on the arc of the arcuate groove. Locking mechanisms (not shown) may be provided to fix the position of the legs when a desired positioning is achieved, or the positions may be fixed by the weight of the table.

Moreover, while in the drawings (e.g., FIG. 1) the upper surface 30 of the support member 22 is shown as being in contact with the lower surface 14 of the table top along its entire length in some cases contact may be discontinuous, for example if it is desired that the support member having an aesthetically pleasing shape.

Accordingly, other embodiments are within the scope of the following claims.

What is claimed is:

1. A table comprising:

a generally planar table top having an upper surface and a lower surface and a thickness between the upper surface and the lower surface;

a plurality of pivoting legs, each pivoting leg having a vertical leg portion having a proximal end adjacent the lower surface and a distal end configured to contact a floor surface to support the table top at a predetermined distance from the floor surface;

a plurality of horizontal elongated support arms, each horizontal elongated support arm being associated with one of the pivoting legs, and each horizontal elongated support arm having a first end mounted to the lower surface of the table top, an elongated body disposed in a plane that is generally parallel to a plane defined by the lower surface of the table top, and a second, distal end to which the proximal end of the associated pivoting leg is mounted; and a pivot mechanism associated with the first end of each support arm to allow the support arm to pivot relative to the table top, the pivot mechanism comprising a cylindrical member that is inserted upwardly through a vertically extending countersunk bore in the first end of the horizontal elongated support arm;

wherein the first end of the support arm is mounted to the lower surface of the table top by a threaded engagement extending only partially through the thickness of the table top.

2. The table of claim 1 wherein the horizontal elongated support arm includes an upper surface that is configured to contact the lower surface of the table top.

3. The table of claim 1 wherein the table top is generally square or rectangular and the table comprises at least four corner legs, arranged at corners of the table top.

4. The table of claim 3, wherein all four of the corner legs are pivoting legs.

5. The table of claim 1 wherein the pivoting leg(s) are pivotable between at least two predetermined positions.

6. The table of claim 5 wherein each pivoting leg further comprises a fastener disposed in the horizontal elongated support arm and configured to secure the pivoting leg in each of the predetermined positions.

7. The table of claim 1 wherein the lower surface of the table includes an arcuate groove and the pivoting leg further comprises a protrusion disposed in the horizontal elongated support arm and configured to travel within the groove when the leg is pivoted.

8. The table of claim 1 wherein the horizontal elongated support arm includes a cylindrical portion at the proximal end and the pivoting mechanism is disposed in the cylindrical portion.

9. A method of providing a reconfigurable table, the method comprising:

providing a table that includes (a) a generally planar table top having an upper surface and a lower surface and a thickness between the upper surface and the lower surface; and (b) a plurality of pivoting legs, each pivoting leg having a vertical leg portion having a proximal end adjacent the lower surface and a distal end configured to contact a floor surface to support the table top at a predetermined distance from the floor surface; (c) a plurality of horizontal elongated support arms, each horizontal elongated support arm being associated with one of the pivoting legs, and each horizontal elongated support arm having a first end mounted to the lower surface of the table top, an elongated body disposed in a plane that is generally parallel to a plane defined by the lower surface of the table top, and a second, distal end to which the proximal end of the associated pivoting leg is mounted; and (d) a pivot mechanism associated with the first end of each support arm to allow the support arm to pivot relative to the table top, the pivot mechanism comprising a cylindrical member that is inserted upwardly through a vertically extending countersunk bore in the first end of the horizontal elongated support arm; wherein the first end of the support arm is mounted to the lower surface of the table top by a threaded engagement extending only partially through the thickness of the table top; and changing the orientation of the vertical leg portion of the pivoting leg, with the vertical leg portion remaining generally perpendicular to the lower surface, by pivoting the horizontal elongated support arm.

* * * * *